US006983671B2

(12) United States Patent
White

(10) Patent No.: US 6,983,671 B2
(45) Date of Patent: Jan. 10, 2006

(54) CANTILEVER-STYLE PEDAL ASSEMBLY

(75) Inventor: Martin White, London (CA)

(73) Assignee: KSR International Co., Ridgetown (CA)

( * ) Notice: Subject to any disclaimer, the term of this patent is extended or adjusted under 35 U.S.C. 154(b) by 311 days.

(21) Appl. No.: 10/424,234

(22) Filed: Apr. 28, 2003

(65) Prior Publication Data

US 2004/0211287 A1 Oct. 28, 2004

(51) Int. Cl.
*G05G 1/14* (2006.01)

(52) U.S. Cl. ..... 74/512; 74/560; 74/513; 192/13 R

(58) Field of Classification Search ..... 74/560, 74/512, 513; 384/296, 275, 438, 428; 188/359; G05G 1/14
See application file for complete search history.

(56) References Cited

U.S. PATENT DOCUMENTS 4,637,741 A * 1/1987 Gillet ..... 384/428
5,829,317 A * 11/1998 Vreeken et al. ..... 74/560
6,138,802 A * 10/2000 McFarlane et al. ..... 192/13 R
6,415,682 B1 * 7/2002 Drew ..... 74/513
6,446,525 B1 * 9/2002 Borchers ..... 74/512
6,796,407 B2 * 9/2004 Buckley et al. ..... 188/359

* cited by examiner

*Primary Examiner*—Vinh T. Luong
(74) *Attorney, Agent, or Firm*—Gifford, Krass, Groh, Sprinkle, Anderson & Citkowski, PC

(57) ABSTRACT

A pedal assembly for a cantilever style pedal includes a support bracket having a mounting face and two spaced apart side walls extending from opposing edges of said mounting face. The pedal assembly also includes a hub assembly rotatably connected between the side walls of the support bracket, wherein the hub assembly includes an outer hub member having a rectangular cross-sectional shape and a rectangular channel extending therethrough, an inner hub member having a solid circular shape, and a bushing disposed in each end of the outer hub member for supporting the inner hub member within the outer hub member. The pedal assembly further includes a first pedal arm, wherein an upper end of the first pedal arm is fixedly mounted to the hub assembly and a pedal pad is mounted to a lower end of the first pedal arm and a second pedal arm, such that a lower end of the second pedal arm is fixedly mounted to the hub assembly, such that the first pedal arm, hub assembly and second pedal arm rotate together as an integral member.

10 Claims, 3 Drawing Sheets

CANTILEVER-STYLE PEDAL ASSEMBLY

FIELD OF THE INVENTION

This invention relates to pedals, and more particularly to an improved cantilever style pedal assembly for a vehicle.

BACKGROUND OF THE INVENTION

Vehicles, such as motor vehicles, typically contain foot-actuated devices or pedals for controlling various functions of the vehicle. These functions are known to include: acceleration, controlled by an accelerator pedal; braking, controlled by a brake pedal; and shifting, controlled by a clutch pedal. In addition, the vehicle may include a non-functional pedal that serves as a footrest for the driver. These pedals are positioned in the vehicle so that they are accessible by the driver, and may be fixed or adjustable.

The pedal assembly includes a pedal arm pivotally mounted to a support bracket, and the support bracket is fixedly mounted to the vehicle. A pedal pad is mounted to a lower end of the pedal arm for depression by the driver's foot. The upper end of the pedal arm is attached to an actuating mechanism for controlling a vehicle function such as braking, accelerating or clutching. Vehicle packaging considerations may influence the shape of the pedal arm. A cantilever style pedal arm has a first pedal arm with a pedal pad attached to a lower end of the first pedal arm and an upper end of the first pedal arm is attached to a hub or cross-member. It also has a second pedal arm attached to the hub at one end and the actuating mechanism at the other end.

The brake and accelerator systems are subject to various regulatory requirements. For a brake system, the regulatory requirements may stipulate braking distance, or a redundancy in the case of a component failure. With respect to a cantilever style brake pedal system, each pedal arm is fixedly mounted to a cross-member, such as by welding. While the weld connection works well, it could fracture when subject to an excessive force, such as in an emergency situation. As a result, each pedal arm would not rotate as a single unit. Thus, there is a need in the art for a cantilever style pedal assembly having an improved structural configuration.

SUMMARY OF THE INVENTION

Accordingly, the present invention is an improved pedal assembly. The pedal assembly includes a support bracket having a mounting face and two spaced apart side walls extending from opposing edges of said mounting face. The pedal assembly also includes a hub assembly rotatably connected between the side walls of the support bracket, wherein the hub assembly includes an outer hub member having a rectangular cross-sectional shape and a rectangular channel extending therethrough, an inner hub member having a solid circular shape, and a bushing disposed in each end of the outer hub member for supporting the inner hub member within the outer hub member. The pedal assembly further includes a first pedal arm, wherein an upper end of the first pedal arm is fixedly mounted to the hub assembly and a pedal pad is mounted to a lower end of the first pedal arm and a second pedal arm, such that a lower end of the second pedal arm is fixedly mounted to the hub assembly, such that the first pedal arm, hub assembly and second pedal arm rotate together as an integral member.

One advantage of the present invention is that a brake pedal assembly is provided that improves brake effectiveness. Another advantage of the present invention is that a pedal assembly is provided with improved structural reliability. A further advantage of the present invention is that the master cylinder and brake booster size are optimized with respect to the pedal ratio as a result of the improved structure.

Other features and advantages of the present invention will be readily understood as the same becomes better understood after reading the subsequent description when considered in connection with the accompanying drawings.

BRIEF DESCRIPTION OF THE DRAWINGS

FIG. 6 is a sectional view taken through line 6—6 of FIG. 1 of the hub assembly, according to the present invention.

DESCRIPTION OF THE PREFERRED EMBODIMENTS

Vehicles, including a motor vehicle (not shown) utilize foot-actuated devices, referred to as pedals, to control a particular function of the vehicle, such as accelerating, braking and shifting. These pedals are referred to in the art as an accelerator pedal, brake pedal, clutch pedal, and parking brake pedal respectively. In addition, the vehicle may include a non-functional pedal that provides a footrest for the non-active foot, such as the left foot in a left-hand drive vehicle. The pedals are aligned in a predetermined dimensional relationship relative to each other, and fixed portions of the vehicle, including the vehicle dash panel, floor, seat and instrument panel. The pedal pad portion of the pedal assembly travels in a predetermined path, typically an arc. In an adjustable pedal assembly, the height of the pedal pad (to be described) with respect to the floor is modified by moving the pedal pad either closer to or away from the driver.

Figure 1:
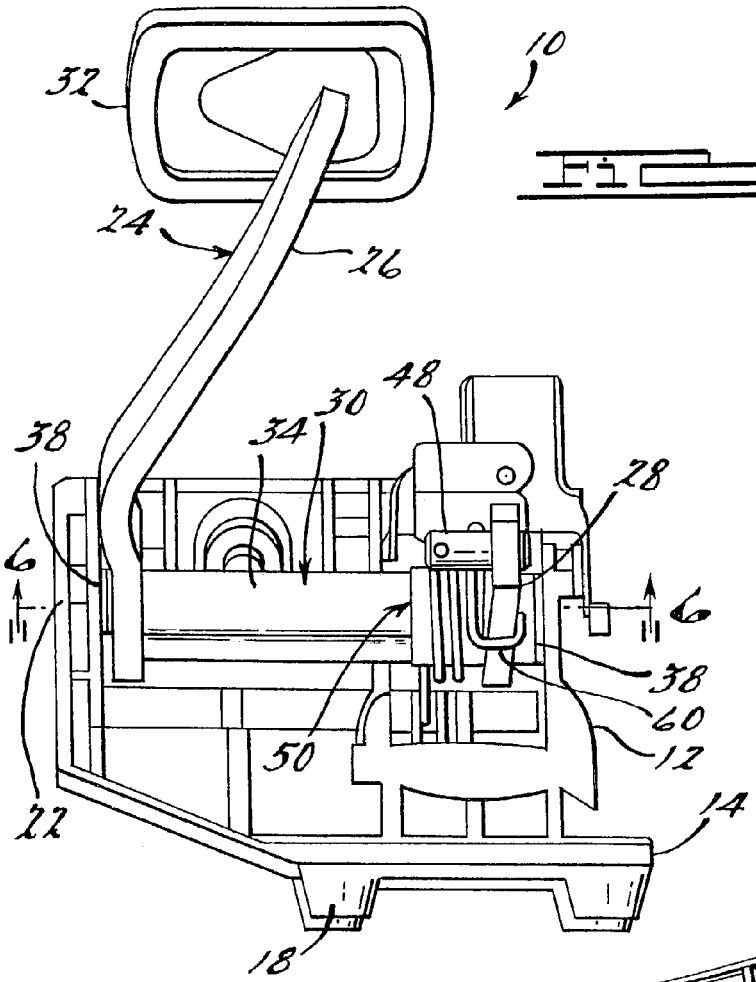
FIG. 1 is a elevational rear view of a pedal assembly, according to the present invention.
Figure 2:
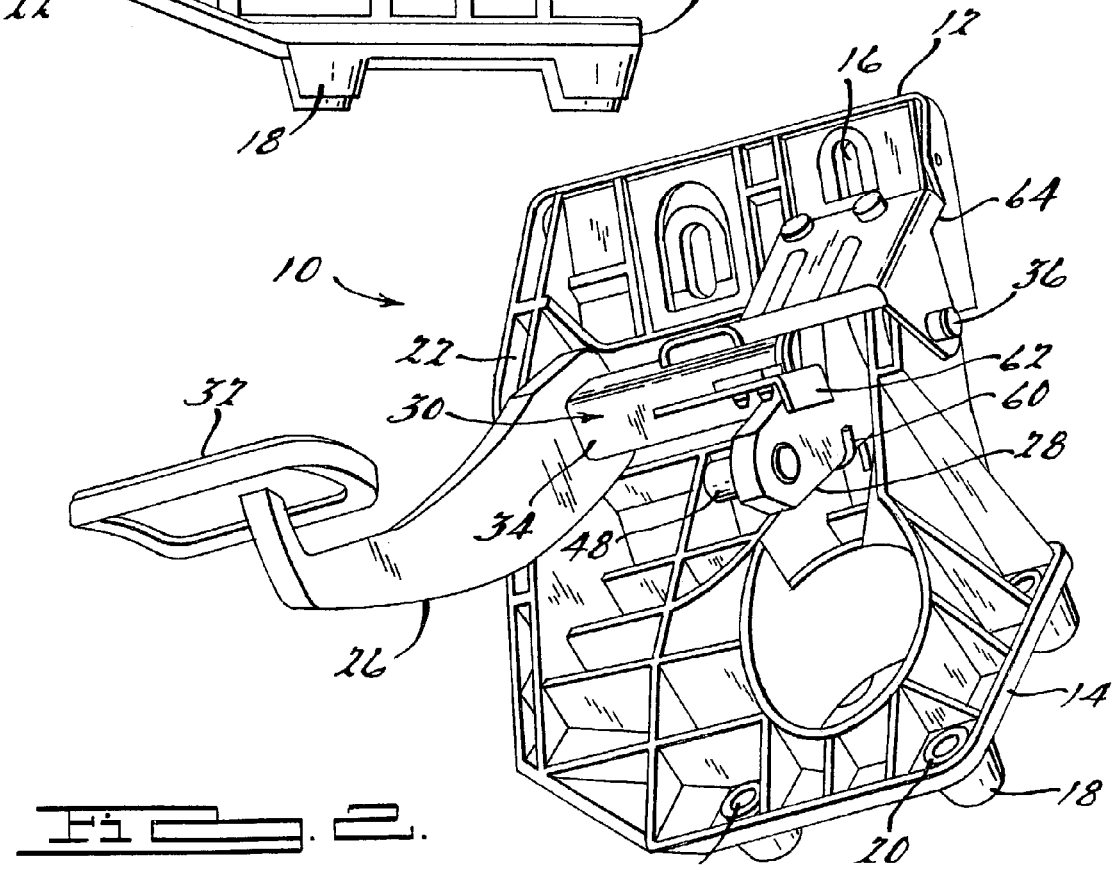
FIG. 2 is a perspective front view of the pedal assembly of FIG. 1, according to the present invention.
Figure 3:
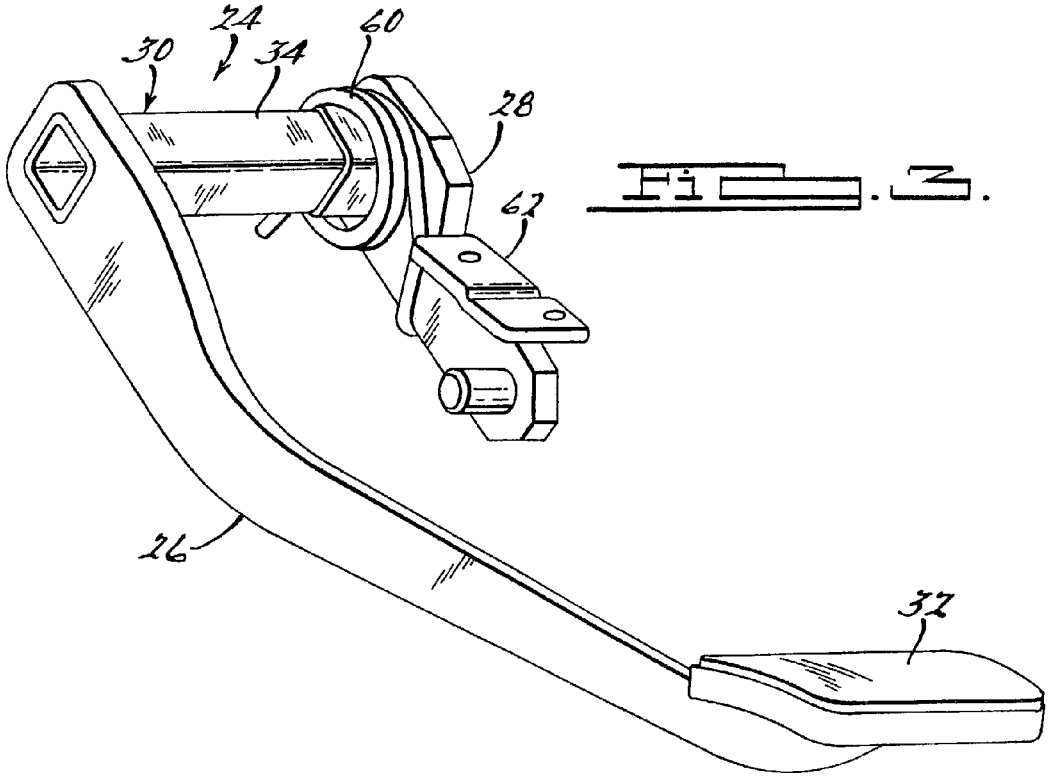
FIG. 3 is a perspective view of the pedal arm assembly of FIG. 1, according to the present invention.
Figure 4:
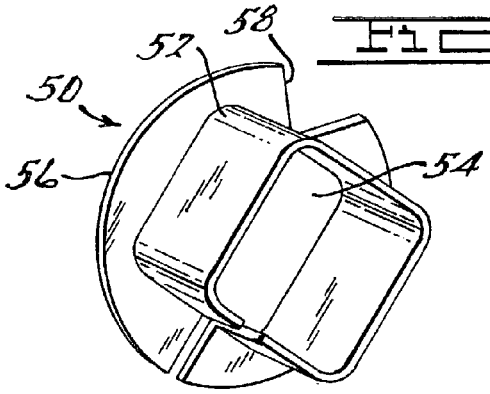
FIG. 4 is a perspective view of a silencer member for use with the pedal assembly of FIG. 1, according to the present invention.
Figure 5:
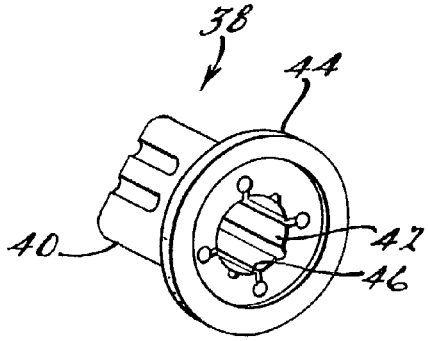
FIG. 5 is a perspective view of hub bushing for use with the pedal assembly of FIG. 1, according to the present invention.
Figure 5:
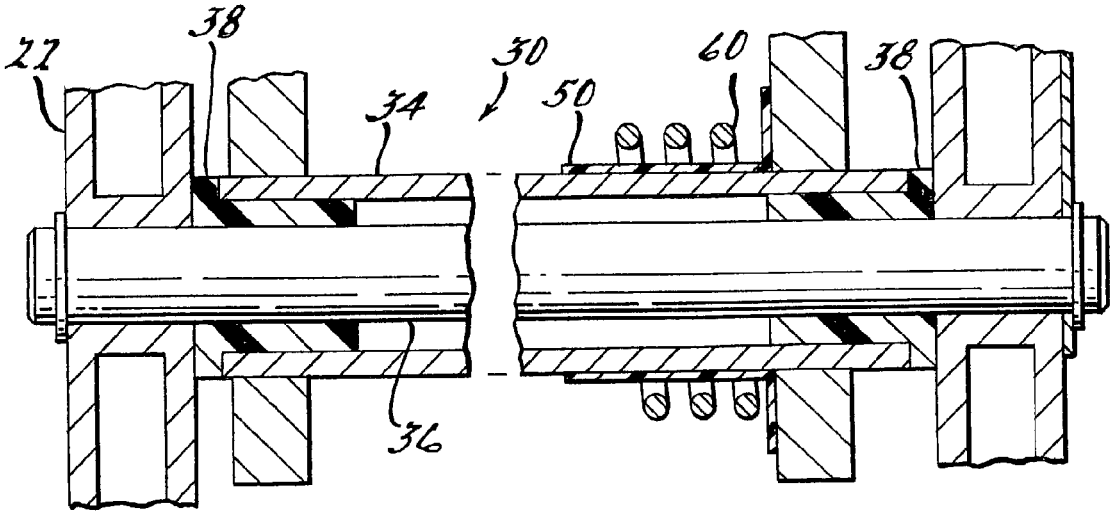

Referring to FIGS. 1–6, a pedal assembly 10 for translating a signal between a vehicle operator or driver (not shown) and an actuating mechanism (not shown) is illustrated. In this example, the pedal assembly is a brake pedal assembly 10. The brake pedal assembly 10 is fixedly mounted to a dash panel portion of the vehicle (not shown) in a conventional position beneath the instrument panel. The brake pedal assembly 10 includes a support bracket 12 for attaching the brake pedal assembly 10 to the dash panel. The support bracket 12 includes a generally planar mounting face 14. In this example the mounting face 14 has an "L" shape. The mounting face includes at least one aperture 16 for attaching the support bracket 12 to the vehicle using an attaching means, such as by bolting or the like. It should be appreciated that in this example the mounting face 14 includes an outwardly projecting boss 18 surrounding the aperture 16, and a reinforcing insert 20 is disposed inside the aperture 16.

The support bracket 12 also includes two spaced apart side walls 22 extending radially from opposing edges of the mounting face 14. Each side wall 22 provides a mounting surface for pivotally supporting the pedal arm assembly, in a manner to be described.

The brake pedal assembly 10 also includes a cantilever style pedal arm assembly 24 having a first pedal arm 26, a second pedal arm 28, and a hub assembly 30 interconnecting the first and second pedal arms 26,28. The first pedal arm 26 has a pedal pad 32 mounted at a lower end. The pedal pad 32 provides a pedal actuation point for transmitting the force of the driver's foot contacting the pedal pad 32 to the braking mechanism to control the movement of the vehicle. Preferably, the pedal pad 32 is made from an isomeric material, such as rubber.

An upper end of the first pedal arm 26 is fixedly attached a hub assembly 30. In this example, the first pedal arm 26 is attached to the hub assembly 30 by welding or the like. The hub assembly 30 functionally supports the first pedal arm 26 and transmits the pivotal movement of the first pedal arm 26 to the second pedal arm 28 and the brake mechanism in a manner to be described. The hub assembly 30 extends longitudinally between the sidewalls 22 of the support bracket 12, and is pivotally supported by the sidewalls 22.

The hub assembly 30 includes an outer member 34 that is tubular and has a rectangular cross-sectional shape. The rectangular cross-sectional shape is advantageous, since it provides improved structural strength and durability. In addition, if the weld connection between either of the pedal arms 26, 28 and outer hub member 34 should break, the orientation of the first pedal arm 26 with respect to the second pedal arm 28 remains fixed, and the first pedal arm 26, second pedal arm 28 and a hub assembly 30 continue to operate as an integral member.

The hub assembly 30 also includes an inner member 36, such as a pivot shaft, supported within the interior portion of the outer member 34 using a hub bushing 38. In this example, the inner member 36 is a longitudinally extending pivot shaft or rod. The inner member 36 is pivotally attached to the sidewall 22 of the support bracket 12, such as by a pivot pin or a shoulder connection or the like.

The hub bushing 38 is disposed within an open end of the outer member 34, and advantageously transfers the motion of the outer member 34 to the inner member 36 or pivot shaft. The hub bushing 38 includes a main portion 40 having a rectangular exterior cross-sectional shape. The interior of the main portion 40 of the hub bushing 38 includes a channel 42 that is circular in cross-sectional shape, for receiving the inner member pivot pin 36. It should be appreciated that a plurality of longitudinally extending channels may be formed in the interior wall of the main portion 40 to facilitate the rotational movement of the inner member 36. The exterior shape of hub bushing 38 corresponds dimensionally to the interior dimensional shape of the outer member 34, and is correspondingly smaller, so that the hub bushing 38 fits within the end of the outer member 34. One end of the hub bushing 38 includes a flange 44 extending radially outward from an end of the main portion 40 of the hub bushing 38. When the hub bushing 38 is inserted in the end of the outer member 34, the flange 44 is positioned between the outer member 34 and sidewall 22, and provides for additional structural support to the hub assembly 30.

The pedal arm assembly 24 further includes a second pedal arm 28 for transferring the rotational motion of the hub assembly 30 and first pedal arm 26 to the brake mechanism. One end of the second pedal arm 28 is fixedly attached to the outer hub member 34, preferably near an opposite end from the first pedal arm 26. The other end of the second pedal arm 28 is pivotally attached to an actuating mechanism such as the brake rod booster link (not shown) that distributes the load transferred from the first pedal arm 26 to the brake mechanism of this example. The second pedal arm 28 is a generally planar member. In this example, the second pedal arm 28 includes a radially extending attaching means 48 for pivotally connecting the second pedal arm 28 to the brake booster rod. In this example the attaching means 48 is a pin, although other types of attaching means are contemplated, such as a ball joint. It should be appreciated that one end of the brake booster rod is operatively attached to the attaching means 48 and another end is operatively attached to the brake booster, as is known in the art, and transmits the force of the operator applying the brakes from the brake pedal assembly 10 to the braking system. The length of the first and second pedal arms 26, 28 and relative position on the outer hub member 34 are configured to obtain the desired geometry.

Preferably, the brake pedal assembly 10 includes a spring member 60 operatively disposed on the hub assembly 30 for controlling the movement of the brake pedal assembly 10 between a resting and braking position, as is known in the art. In this example, the spring member 60 is a torsion spring.

The brake assembly 10 also includes a silencer member 50, or bushing, placed on the outer hub member 34 in a predetermined location. Advantageously, the silencer member 50 reduces or eliminates any noise between the spring 60 and the outer hub member 34. The silencer member 50 includes a main portion 52 having a rectangular cross-sectional shape and a hollow center portion 54. One end of the main portion 52 includes a radially extending flange 56 that is circular in shape. It should be appreciated that the radially extending flange 56 may include a cut-away portion 58 to accommodate packaging the second pedal arm 28 and spring member 60 on the hub assembly 30.

It should be appreciated that the brake pedal assembly 10 may include other components, such as switches 62, switch mounting brackets 64 or a stop (not shown), which are conventional and known in the art for the brake pedal assembly 10.

In operation, as the driver depresses the pedal pad 32, the rotational movement of the first pedal arm 26 is transferred to the hub assembly 30, which transfers the motion to the second pedal arm 28. The motion is transferred from the second pedal arm 28 to the brake booster rod, and the braking mechanism of this example, to control the movement of the vehicle, by applying a force to slow down the rotational movement of the vehicle. It should be appreciated that the first pedal arm 26, hub assembly 30 and second pedal arm 28 rotate as a single, integral member. Advantageously, the structural strength of the hub assembly 30 is improved by combining the rectangular outer member 34 and circular inner member 36, versus a single pivot rod. In addition, the first pedal arm 26, hub assembly 30 and second pedal arm 28 will rotate as an integral member, regardless of the integrity of the weld connection.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A pedal assembly comprising:

a support bracket having a mounting face and two spaced apart side walls extending from opposing edges of said mounting face;

a hub assembly having an outer hub member positioned between the side walls of said support bracket wherein said outer hub member has a rectangular circumference and a channel extending transversely therethrough with a rectangular circumference, a one-piece, solid inner hub member, and each end of said inner hub member is rotatably supported by the side walls of said support bracket and disposed within the outer hub member channel, wherein said inner hub member has a circular circumference, and a bushing disposed in each end of said outer hub member adjacent the side wall for supporting said inner hub member within said outer hub member channel;

a first pedal arm, wherein an upper end of said first pedal arm is fixedly mounted to said hub assembly and a pedal pad is mounted to a lower end of said first pedal arm; and a second pedal arm, wherein a lower end of said second pedal arm is fixedly mounted to said hub assembly, such that the first pedal arm, hub assembly and second pedal arm rotate together as an integral member.

2. A pedal assembly as set forth in claim 1 wherein said inner hub member is a pivot pin, and said pivot pin is pivotally supported by said side walls of said support bracket.

3. A pedal assembly as set forth in claim 1 further comprising a spring operatively disposed on said hub assembly for returning the first and second pedal arm to a predetermined position.

4. A pedal assembly as set forth in claim 1 wherein said hub bushing includes a main portion that has a uniformly rectangular circumference with an inner bore extending therethrough the main portion that has a circular circumference and a flange extending radially from an end of the main portion.

5. A hub assembly as set forth in claim 1 further comprising a silencing bushing positioned over said outer hub member, wherein said silencing bushing includes a main portion that has a rectangular circumference with an inner bore corresponding to the circumference of said outer hub member, and a flange extending radially from an edge of the main portion.

6. A brake pedal assembly comprising:

a support bracket having a mounting face and two spaced apart side walls extending from opposing edges of said mounting face;

a hub assembly having an elongated outer hub member positioned between the side walls of said support bracket wherein said outer hub member has a rectangular circumference and a channel extending transversely therethrough with a uniform rectangular circumference, an elongated one-piece solid inner hub member, and each of said inner hub member is rotatably supported by the side walls of said support bracket, and said inner hub member is disposed within the outer hub member channel, wherein said inner hub member has a circular circumference;

a bushing disposed in each end of said outer hub member for supporting said inner hub member within the rectangular channel in said outer hub member, wherein said hub bushing includes a main portion that has a uniformly rectangular circumference with an inner bore extending therethrough the main portion with a circular circumference and a flange extending radially from an end of the main portion a first pedal arm, wherein an upper end of said first pedal arm is fixedly mounted to said hub assembly and a pedal pad is mounted to a lower end of said first pedal arm; and a second pedal arm, wherein a lower end of said second pedal arm is fixedly mounted to said hub assembly, such that the first pedal arm, hub assembly and second pedal arm rotate together as an integral member.

7. A pedal assembly as set forth in claim 6 wherein said inner hub member is a pivot pin, and said pivot pin is pivotally supported by said side walls of said support bracket.

8. A pedal assembly 6 further comprising a silencing bushing positioned over said outer hub member, wherein said silencing bushing includes a main portion that has a rectangular shape, circumference with an inner bore corresponding to the circumference of said outer hub member, and a flange extending radially from an edge of the main portion.

9. A brake pedal assembly comprising:

a support bracket having a mounting face and two spaced apart side walls extending from opposing edges of said mounting face;

a hub assembly having an elongated outer hub member positioned between the side walls of said support bracket wherein said outer hub member has a rectangular circumference with a channel having a uniformly rectangular circumference extending therethrough, and an elongated one-piece solid inner hub member, and each end of said inner hub member is rotatably supported by the side walls of said support bracket, and said inner hub member is disposed within said outer hub member channel. Wherein said inner hub member has a circular circumference;

a bushing disposed in each end of said outer hub member for supporting said inner hub member within the rectangular channel in said outer hub member, wherein said hub bushing includes a main portion that has a uniformly rectangular circumference with an inner bore extending therethrough the main portion with a circular circumference and a flange extending radially from an end of the main portion;

a first pedal arm, wherein an upper end of said first pedal arm is fixedly mounted to said hub assembly and a pedal pad is mounted to a lower end of said first pedal arm;

a second pedal arm, wherein a lower end of said second pedal arm is fixedly mounted to said hub assembly, such that the first pedal arm, hub assembly and second pedal arm rotate together as an integral member;

a spring operatively disposed on said hub assembly for returning said first and said second pedal arm to a predetermined position; and a silencing bushing positioned over said outer hub member, wherein said silencing bushing includes a main portion that has a rectangular circumference with an inner bore corresponding to the circumference of said outer hub member, and a flange extending radially from an edge of the main portion.

10. A pedal assembly as set forth in claim 9 wherein said inner member is a pivot pin, and said pivot pin is pivotally supported by said side walls of said support bracket.

* * * * *

UNITED STATES PATENT AND TRADEMARK OFFICE

CERTIFICATE OF CORRECTION

PATENT NO. : 6,983,671 B2
APPLICATION NO. : 10/424234
DATED : January 10, 2006
INVENTOR(S) : Martin White It is certified that error appears in the above-identified patent and that said Letters Patent is hereby corrected as shown below:

Column 6, line 36 - please delete “channel- wherein” and insert --channel, wherein--.

Signed and Sealed this

First Day of August, 2006

JON W. DUDAS
*Director of the United States Patent and Trademark Office*